US009887496B2

(12) United States Patent
Janssen et al.

(10) Patent No.: US 9,887,496 B2
(45) Date of Patent: Feb. 6, 2018

(54) CONTACT CONNECTING OF SHIELDED DATA LINES TO A BOARD AND METHOD FOR CONTACTING A NUMBER OF SHIELDED DATA LINES WITH A BOARD

(71) Applicant: LEONI KABEL GMBH, Nuremberg (DE)

(72) Inventors: Bernd Janssen, Friesoythe ot Neuscharrel (DE); Christoph Untiedt, Klein Berssen (DE)

(73) Assignee: LEONI Kabel GmbH, Nuremberg (DE)

( * ) Notice: Subject to any disclaimer, the term of this patent is extended or adjusted under 35 U.S.C. 154(b) by 0 days.

(21) Appl. No.: 15/180,244

(22) Filed: Jun. 13, 2016

(65) Prior Publication Data

US 2016/0294122 A1 Oct. 6, 2016

Related U.S. Application Data

(63) Continuation of application No. PCT/EP2014/077610, filed on Dec. 12, 2014.

(30) Foreign Application Priority Data

Dec. 12, 2013 (DE) ..... 10 2013 225 794

(51) Int. Cl.
*H01R 13/6594* (2011.01)
*H01R 9/03* (2006.01)
(Continued)

(52) U.S. Cl.
CPC ..... *H01R 13/6594* (2013.01); *H01R 4/28* (2013.01); *H01R 9/034* (2013.01); *H01R 9/035* (2013.01);
(Continued)

(58) Field of Classification Search
CPC ..... H01R 13/6594; H01R 13/6592; H01R 13/6595; H01R 13/6596; H01R 12/53;
(Continued)

(56) References Cited

U.S. PATENT DOCUMENTS 6,200,162 B1 * 3/2001 Aoyama ..... H01R 4/184 439/578
6,575,772 B1 * 6/2003 Soubh ..... G01R 1/18 439/581
(Continued)

FOREIGN PATENT DOCUMENTS

CN 1123098 C 10/2003
CN 1930737 A 3/2007
(Continued)

*Primary Examiner* — Harshad C Patel
(74) *Attorney, Agent, or Firm* — Laurence A. Greenberg; Werner H. Stemer; Ralph E. Locher

(57) ABSTRACT

In a contact connecting of preferably a number of shielded conductor pairs to a board in particular of a plug for high-speed data connections, the board is formed of multiple layers and contains a conductor path tier and a ground tier. A ground contact zone of the ground tier projects, in a tongue-like manner, towards the connected conductor pairs. In the region of the ground contact zone, the individual conductor pairs are pressed in contact against the corresponding pair shielding thereof. To this end, in particular a clamping element is provided that is also used to achieve the shield contacting.

15 Claims, 3 Drawing Sheets

(51) Int. Cl.

| | |
|---|---|
| ***H01R 13/6592*** | (2011.01) |
| ***H01R 13/6595*** | (2011.01) |
| ***H01R 13/6596*** | (2011.01) |
| ***H01R 4/28*** | (2006.01) |
| *H01R 12/53* | (2011.01) |
| *H01R 12/57* | (2011.01) |
| *H01R 13/66* | (2006.01) |

(52) U.S. Cl.
CPC ..... *H01R 13/6592* (2013.01); *H01R 13/6595* (2013.01); *H01R 13/6596* (2013.01); *H01R 12/53* (2013.01); *H01R 12/57* (2013.01); *H01R 13/6658* (2013.01)

(58) Field of Classification Search
CPC .... H01R 12/57; H01R 12/594; H01R 12/592; H01R 13/6658; H01R 9/034; H01R 9/035; H01R 4/28
USPC ..... 439/607.35
See application file for complete search history.

(56) References Cited

U.S. PATENT DOCUMENTS

| | | | | |
|---|---|---|---|---|
| 7,371,128 | B2 * | 5/2008 | DeLessert | G01R 1/06772 439/700 |
| 8,298,009 | B2 * | 10/2012 | Elkhatib | H01R 12/594 439/581 |
| 8,444,430 | B2 | 5/2013 | Kappla et al. | |
| 8,556,646 | B2 | 10/2013 | Kappla et al. | |
| 8,928,849 | B2 * | 1/2015 | Horino | G06F 3/044 200/512 |
| 9,658,503 | B2 | 5/2017 | Horino | |
| 2007/0111597 | A1 * | 5/2007 | Kondou | H01R 24/44 439/581 |
| 2008/0207021 | A1 * | 8/2008 | Hsu | H01R 13/6658 439/79 |
| 2009/0260847 | A1 | 10/2009 | Tobben et al. | |
| 2010/0210142 | A1 * | 8/2010 | McGrath | H01R 12/594 439/620.22 |
| 2011/0108876 | A1 * | 5/2011 | Yen | H01L 24/03 257/99 |
| 2011/0151716 | A1 * | 6/2011 | Kondo | H01R 13/6658 439/607.01 |
| 2011/0195593 | A1 | 8/2011 | McGrath et al. | |
| 2011/0287642 | A1 * | 11/2011 | Wang | H01R 9/031 439/83 |
| 2012/0000703 | A1 * | 1/2012 | Kim | H01R 13/6592 174/70 R |
| 2012/0061140 | A1 | 3/2012 | Nonen et al. | |
| 2013/0225004 | A1 | 8/2013 | Behziz et al. | |
| 2013/0264107 | A1 | 10/2013 | Meyers | |
| 2015/0171561 | A1 * | 6/2015 | Little | H01R 24/60 439/607.34 |

FOREIGN PATENT DOCUMENTS

| | | | |
|---|---|---|---|
| CN | 102707851 | A | 10/2012 |
| DE | 29621580 | U1 | 4/1997 |
| EP | 2112669 | A2 | 10/2009 |
| EP | 2224552 | A2 | 9/2010 |
| WO | 2011072869 | A1 | 6/2011 |
| WO | 2011089003 | A1 | 7/2011 |

* cited by examiner

CONTACT CONNECTING OF SHIELDED DATA LINES TO A BOARD AND METHOD FOR CONTACTING A NUMBER OF SHIELDED DATA LINES WITH A BOARD

CROSS-REFERENCE TO RELATED APPLICATION

This is a continuation application, under 35 U.S.C. § 120, of copending international application No. PCT/EP2014/077610, filed Dec. 12, 2014, which designated the United States; this application also claims the priority, under 35 U.S.C. § 119, of German patent application No. DE 10 2013 225 794.5, filed Dec. 12, 2013; the prior applications are herewith incorporated by reference in their entirety.

BACKGROUND OF THE INVENTION

Field of the Invention

The invention relates to a contact connection of shielded data lines to a board and to a method for contacting a number of shielded data lines with a board.

In the sphere of data transmission, for example in computer networks, for the data transmission use is made of data cables in which typically a plurality of data lines is combined in a common cable sheath. In the case of high-speed data transmissions, the data lines used are in each case shielded pairs of insulated wires, wherein the two insulated wires in particular run parallel to each other or alternatively are twisted with each other. A respective insulated wire consists here of the actual conductor, for example a solid conductor wire or else a stranded wire, which is surrounded in each case by insulation. The pair of insulated wires of a respective data line is surrounded by a (pair) shielding. The data cables typically have a multiplicity of such shielded pairs of insulated wires which are surrounded by a common cable sheath.

Data cables of this type are connected in pre-manufactured form to connectors. In high speed transmission applications, the connectors here are frequently configured as what are referred to as small form pluggable connectors, SFP connectors for short. There are different variant embodiments in this connection, for example what are referred to as SFP connectors, SFP+ connectors, or CXP QSFP connectors. These connectors have special connector housings, as can be gathered, for example, from international patent disclosures WO 2011 072 869 A1 (corresponding to U.S. Pat. No. 8,444,430) or WO 2011 089 003 A1 (corresponding to U.S. Pat. No. 8,556,646).

The interior of such connector housings has a printed circuit board or board sometimes with integrated electronics. The respective data cable is to be connected to the board on a rear side of the connector. The individual insulated wires of the data cable are soldered here to the board. At the opposite end of the board, the board typically forms a plug-in tongue with connection contacts, said plug-in tongue being plugged into a mating connector. Boards of this type are also referred to as paddle cards.

In the case of data connections of this type having a very high transmission frequency, reliable shielding is of crucial importance. The shielding of the individual data lines, i.e. of the individual pairs of insulated wires, has to be reliably connected here to the respective connector, in particular to the board.

A "ground wire" which is electrically connected to the shielding and via which ultimately the electrical contacting of the shielding with a ground connection of the board takes place is frequently arranged in a respective data line. One ground wire is customarily provided per pair of insulated wires, which are typically stranded together in pairs in the manner of a twisted pair, and a plurality of pairs of insulated wires is connected. Such a data line with a ground wire can be gathered, for example, from published European patent application EP 21 12 669 A2 (corresponding to U.S. patent publication No. 2009/0260847). However, the contacting of the ground wire is associated with complexity in terms of production, and also, because of the individual contacting of the ground wires of the various data lines, a certain construction space is required which is troublesome in the case of the comparatively small connectors. The ground wire also has to be aligned in order to guide it to the desired connection position.

SUMMARY OF THE INVENTION

Taking this as the starting point, the invention is based on the object of permitting a contact connection of shielded data lines of a data cable to a board, in particular during the production of connectors of this type, which contact connection is simple to manufacture and is constructed compactly.

This object is achieved according to the invention by a contact connection with the features of the main claim. The board, in particular a connector board of the small form pluggable type of connector, is typically of multi-layered construction and has at least one strip conductor plane, in particular with integrated electronics, and a ground plane. The ground plane of the board is configured here projecting in the manner of a tongue in the direction of the data lines to be connected and, in the projecting partial region, has a ground contact zone with which the at least one, preferably more than one, data line is in contact by the shielding thereof. For this purpose, the shielding is fixed in a suitable manner on the ground contact zone; in particular, the shielding is pressed against the ground contact zone, and/or is adhesively bonded, soldered or welded thereto. The contact connection is suitable in principle for all types of connector which are equipped with "paddle cards", i.e. in which the conductors of the line are directly in contact with a board.

Instead of individual contacting of a respective ground wire of a data line, the individual data lines are now in each case placed together next to one another by the shielding thereof on the ground contact zone in a simple manner and brought into contact with the ground contact zone, in particular pressed against the latter and suitably fixed. This firstly dispenses with the necessity of the individual contacting of the ground wires, as a result of which the outlay on manufacturing and connection is significantly reduced. In addition, the manufacturing reliability is also increased as a result since, when ground wires are used, the problem of short circuits via the ground wire frequently occurs.

The data lines are in particular in each case a pair of insulated wires surrounded by a pair shielding, wherein customarily a plurality of such pairs of insulated wires surrounded by a pair shielding are combined in a data cable and surrounded by a common cable sheath. The pair shielding is typically an also multi-layered film structure with at least one metallic film which is fitted, preferably longitudinally folded, about the pair of insulated wires. In addition to the metallic film, in particular aluminum film, the film shielding has an additional plastics film, for example polyester film, which is frequently of adhesive design for installation purposes. The insulated wires are preferably guided parallel to one another.

In an expedient development, the use of a ground wire is omitted. In addition to saving the material costs and the manufacturing costs for the ground wire, the additional advantage of reducing the diameter of the entire data cable in comparison to a data cable with ground wires is therefore achieved. Owing to the simple connection of the shieldings to the ground contact zone, a ground wire of this type is no longer required for a reliable ground connection. The latter is on the contrary ensured via the flat ground contact zone.

Expediently, the ground contact zone extends at least over a large part of the width and preferably over the entire width of the board. In an expedient design, it is formed here in a simple manner as a metal layer which, for example, is sprayed on. Alternatively, the ground contact zone is formed by vapor deposition or else by fitting on, in particular adhesively bonding on, a film. Overall, a very large ground contact zone is therefore formed. Therefore, no special positioning requirements are created for the contact connection.

With regard to as reliable and secure a ground contacting as possible, the shieldings of the data lines are connected in a first variant to the ground contact zone by an integrally bonded connection, for example by adhesive bonding, soldering or welding.

In a particularly preferred refinement, the shieldings are alternatively or additionally pressed against the ground contact zone by a preferably common clamping element. The use of a common clamping element additionally also permits simple installation. The individual data lines merely need to be initially placed by the shieldings thereof onto the ground contact zone and subsequently connected in a clamping manner to the board by a fastening element configured as a clamping element.

The clamping element is expediently configured here in a conductive manner and is configured in particular as a metal strip which runs transversely with respect to the longitudinal direction of the board. The metal strip serves for the additional shield contacting and is preferably additionally connected to the ground contact zone or to another ground conductor. Such a ground conductor can also be a housing part of a connector in which the board is located. In this case, the counterbearing to which the clamping element is, for example, screwed is then a housing part.

The clamping element is preferably configured in the manner of an arc which is bent at its opposite ends somewhat downward toward the ground plane and, in the opposite end regions, is fastened preferably to the board, in particular to the ground plane. For this purpose, fastening holes for a screw fastening are, for example, arranged in the opposite end regions. Alternatively, the metal arc can also be soldered on or adhesively bonded on.

The clamping element preferably has guides for the individual data lines and, for this purpose, is in particular of wavy or else crenellated design. An individual guide for a respective insulated wire of the data line is therefore provided by a corresponding wave trough. By this means, firstly, as large a contacting and clamping as possible between the clamping element and the shielding is achieved. The individual wave troughs preferably have the same radius here as the shielded insulated wires. A further particular advantage of the individual guides can be seen in the fact that the individual insulated wires are fixed in their position by the clamping element. By this means, simple installation is ensured.

As already explained, the shielding is expediently configured as a multi-layered film with a metal film, in particular aluminum film, and with an insulation film, or else is designed as a metalized insulation film. For the connection of a respective data line, it is first of all required for the shielding in a front conductor connection region to be removed from the pair of insulated wires such that the latter is exposed for the actual contacting of the conductor. For this purpose, the shielding is expediently turned over rearward or turned upside down such that the shielding is of double-layered design in the region of the ground contact zone, i.e. in a ground contact region. This is firstly comparatively simple in terms of manufacturing and, in addition, high contact security is thereby achieved.

In application situations in which the insulation film is oriented inward with respect to the pair of insulated wires, the insulation film would be oriented outward because of the folding over and would act as insulation for the ground contact zone. In particular in this case, the insulation film is removed in the region of the ground contact zone. This expediently takes place by local thermal treatment, for example with the aid of a laser. Alternatively, in this case, in which the conductive layer already points outward, there is preferably no folding over and the conductive layer is directly contacted.

In addition to the contacting of the shieldings, the individual data conductors are connected in an electrically conductive manner to the board. For this purpose, the data conductors are guided in the longitudinal direction of the data cable or of the board beyond the ground contact zone and brought into contact with a strip conductor of the strip conductor plane. The contacting takes place here customarily by a soldered connection. The insulation of a respective insulated wire is removed beforehand so that a blank data conductor is present in the conductor contact region.

The ground plane is expediently formed by a central plane of the board, on which further planes, in particular the strip conductor planes with strip conductors and/or integrated electronics, are therefore arranged on both sides. As already mentioned, the central plane is guided in a tongue-like manner in the rearward direction beyond the other strip conductor planes. The ground plane expediently has a ground contact zone on both sides with shieldings connected to the latter. The plurality of data lines of the data cable are therefore connected to the ground contact zone on both sides. The same preferably also applies to the individual data conductors which are in each case connected to opposite outer layers (strip conductor planes). This results overall in a compact construction.

The ground plane is preferably a mechanical carrier, for example composed of a non-conductive carrier material, in particular a printed circuit board material, for example with the material identification FR4. A ground conductor is fitted in each case preferably on both sides of said non-conductive carrier. The ground conductor is fitted here in particular as a full-faced metalization layer on both sides of the carrier. The ground conductor is preferably composed here of copper. Alternatively, use is made of a conductive carrier, in particular made of solid metal, which then itself acts as the ground conductor.

In the region of the ground contact zone, the carrier, preferably together with the ground conductor fitted thereon, extends in the manner of a tongue beyond the further layer structure. According to a first variant embodiment, the ground conductor itself forms the ground contact zone. However, according to a preferred development, an additional metal or contact layer made from a material having very high conductivity and good contact properties is applied in the region of the ground contact zone. In particular, a gold layer is applied as the additional metal layer.

According to a preferred development, at least the ground contact zone together with the shielding, which is in contact therewith, is enclosed by a sealing compound. By this means, corrosion problems which may occur in the event of moisture because of the material pairing between the different metals of the ground contact zone, customarily gold, and of the shielding, customarily aluminum, are reliably avoided. In addition, the adjoining region is expediently also enclosed by the sealing compound, by the individual insulated conductor wires being in contact with the board, in particular being soldered thereto. The shieldings and the ground contact zone are expediently embedded in the sealing compound. The latter is preferably configured as a casting or injection molding compound, as an adhesive, as an epoxy resin or else as a "hotmelt".

The object is furthermore achieved according to the invention by a method for contacting a number of shielded data lines with a board.

The advantages explained with regard to the contact connection and preferred refinements can expediently also be transferred to the method.

Other features which are considered as characteristic for the invention are set forth in the appended claims.

Although the invention is illustrated and described herein as embodied in a contact connecting of shielded data lines to a board and a method for contacting a number of shielded data lines with a board, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
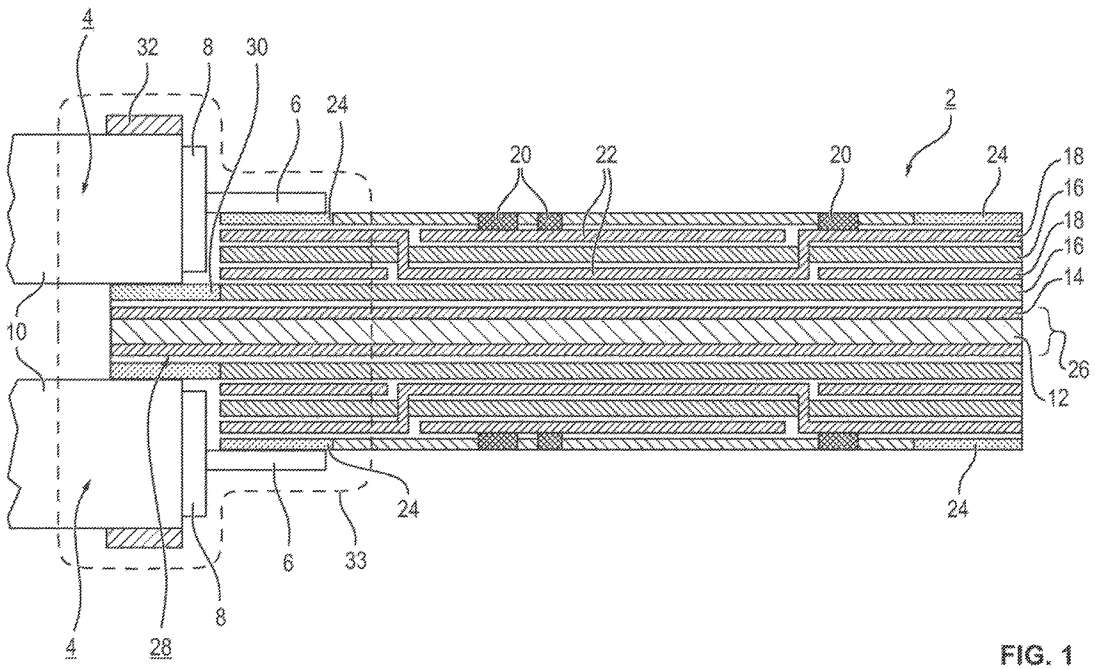
FIG. 1 is a diagrammatic, sectional view through a contact connection of shielded pairs of insulated wires on a board according to the invention.

In the figures, parts with like effect are in each case provided with the same reference signs.

Referring now to the figures of the drawings in detail and first, particularly to FIGS. 1 and 2 thereof, there is shown a contact connection described below and contains a board 2 and a plurality of data lines which are in electrical contact therewith and are in each case configured as shielded pairs of insulated wires 4. A shielded pair of insulated wires 4 of this type is in particular also illustrated with reference to FIG. 4. The shielded pair of insulated wires 4 contains data conductors 6 which are in each case surrounded by insulation 8. The pair of insulated wires 4 is surrounded by a common pair shielding 10 which is configured as a film shielding. The pair shielding 10 typically has a multi-layered structure composed of a metal layer (aluminum) and a plastics layer. For example, the metal layer is applied to a plastics layer by metallization. The plastics layer may be a plastics film, in particular PET film.

Figure 4:
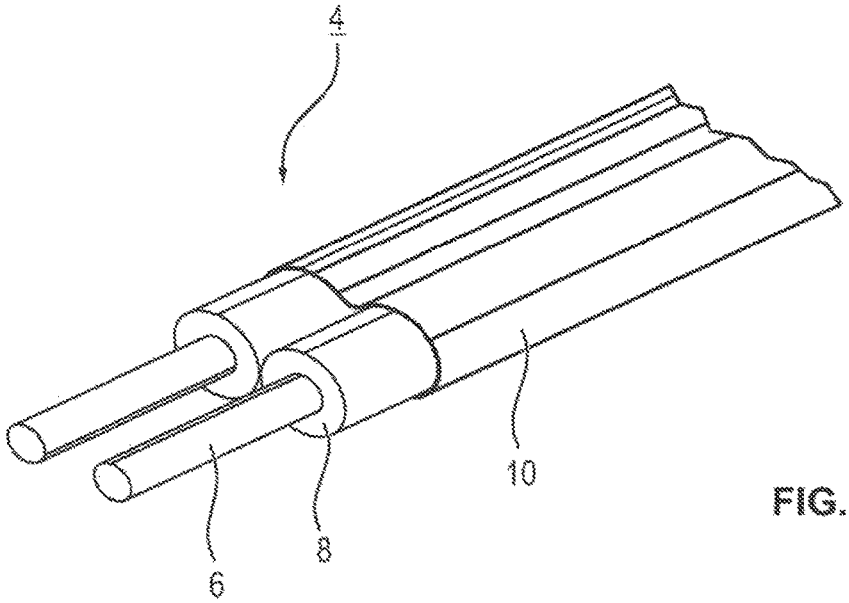
FIG. 4 is a perspective partial illustration of a shielded pair of insulated wires.

As can be gathered in particular from FIG. 4, the individual insulated wires consisting of the data conductor 6 with the respective insulation 8 run parallel to one another. The pair shielding 10 is configured as a longitudinally folded film, wherein an overlapping region is formed in the gusset region between the two insulated wires. As can furthermore be gathered from FIG. 4, an otherwise customary ground wire which is typically likewise arranged running in the longitudinal direction of the pair of insulated wires 4, for example in the gusset region between the individual insulated wires, is omitted in the case of the shielded pair of insulated wires 4.

The board 2 has a multi-layered structure and is formed symmetrically with respect to a center plane. The layer structure here contains a centrally arranged carrier 12 on which a layer sequence is in each case constructed on both sides. A ground conductor 14 which is configured in particular as a metallization of the carrier 12, for example as a copper metallization, is fitted on the carrier 12, preferably over the full surface. The ground conductor 14 extends over the entire length of the carrier 12.

In the figure, the individual layers are illustrated separately from one another with an intermediate space in the manner of an exploded illustration merely for better illustration. They are directly consecutive without intermediate spaces.

The carrier itself is composed of a customary insulating printed circuit board material, for example with the material identification FR 4. Further insulation layers 16 and strip conductor planes 18 adjoin the ground conductor 14 in an alternating manner. The further insulation layers 16 are preferably composed here of a special insulating printed circuit board material which is suitable for high-frequency applications. The outermost strip conductor layer 18 is equipped in a central region with electronic components 20 which are electrically in contact with one another via the individual strip conductors 20. Furthermore, the outermost strip conductor layer 18 has a plurality of connection pads 24 to which the data conductors 6 of the individual pairs of insulated wires 4 are connected. Connection pads 24 are likewise formed on the front side of the board 2 opposite the pairs of insulated wires 4. An electrical connection to corresponding contact elements of a contact connector, into which the board 2 is plugged in order to form a plug-in connection, takes place via the connection pads. The connection pads 24 are preferably formed here by the application of an additional metal layer, in particular gold layer.

Figure 2:
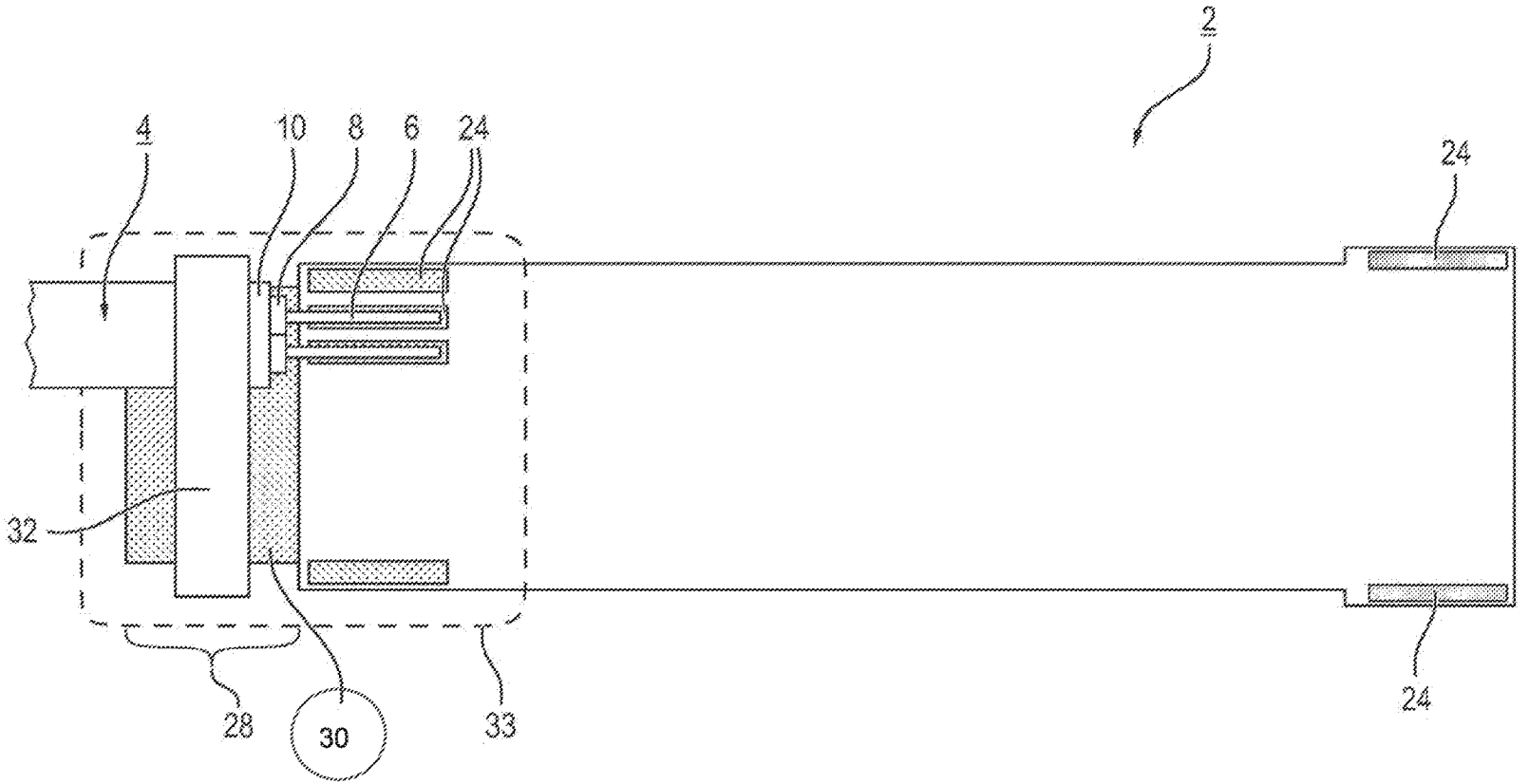
FIG. 2 is a simplified schematic diagram of a top view of the contact connection of this type.

As can be seen in particular from FIG. 1, the carrier 12 is extended in a rearward region of the board 2, which region is oriented toward the pairs of insulated wires 4, beyond the rest of the layer structure such that a type of projecting tongue is formed. Together with the carrier 12, the ground conductor 14 is also extended into the projecting region. The carrier 12 forms a ground plane 26 with the ground conductor 14. The projecting partial region forms a ground contact zone 28 of the ground plane 26.

In the region of the ground contact zone 28, an additional metal layer 30, in particular composed of gold, is applied to the ground conductor 14.

The respective pair of insulated wires 4 rests by the pair shielding 10 on this ground contact zone 28 in a contacting manner. In addition, a respective clamping element 32, which is illustrated merely schematically and in highly simplified form in FIGS. 1 and 2, is arranged on the side opposite the ground contact zone 28. With the clamping element, the pair of insulated wires 4 is pressed in the region of the exposed pair shielding 10 against the board 2. The clamping element 32 here is in particular of conductive design, and therefore an additional contacting of the pair shielding 10 also takes place via the clamping element 32. The clamping element 32 here is configured, for example, as a metal strip or metal clip which is connected, for example, to the board in order to exert the desired clamping force. For this purpose, a screw fastening or else an adhesive fastening can be provided.

This measure overall permits simple connection of the pair shielding 10 to the ground plane 26 of the board 2. All that is needed is for a plurality of pairs of insulated wires 4 to be placed next to one another onto the ground contact zone 28 and to be braced against the ground contact zone 28 by the clamping element 32.

Significantly simplified installation is achieved as a result in comparison to the previously customary contactings via individual ground wires. In comparison to the contacting of ground wires, the contact security is also significantly increased, and there is no risk of short circuits etc. occurring due to an imprecise positioning of the ground wires. Finally, dispensing with ground wires also makes it possible overall to reduce the diameter of the pair of insulated wires 4 and in particular of a data cable consisting of a multiplicity of such pairs of insulated wires 4.

In addition to the contacting of the pair shielding 10, the individual data conductors 6 are also connected to the respective connection pads 24 individually in an electrically contacting manner, for example by soldering.

In order to form the shield contacting, the possibly interfering plastics film of the pair shielding 10 is removed when required. Depending on the variant embodiment, the plastics film may constitute that layer of the pair shielding 10 which is located on the inside or outside. If the plastics film is on the outside, it is removed before the shield connection. For this purpose, in particular a thermal laser treatment is provided.

In order to improve the contact connection, the pair shielding 10 is expediently folded back in the front region such that it is overall of double-layered design. In the case of pair shieldings 10 with an inner plastics film, this leads to the latter now lying on the outside and therefore being removed as described.

A seal which is formed by a sealing compound 33 and is indicated by a dashed line is formed at least in the region of the ground contact zone 28 and, in the exemplary embodiment, also in the region of the connection pads 24. The seal in particular surrounds the ground contact zone 28 with the shieldings 10 which are in contact therewith and are therefore embedded together in the sealing compound 33. In addition, in the exemplary embodiment, the clamping element 32 is also embedded. In particular the critical contact region between the gold ground contact zone 28 and the aluminum shields 10 is sealed off from moisture by the sealing compound 33. The sealing compound 33 is applied, for example, by an (injection molding) casting process or else in the manner of an adhesive as an epoxy resin or a hotmelt. The sealing compound 33 is applied exclusively in the contact region where the data conductors 6 and the shielding 10 are in contact with the board 2.

Figure 3:
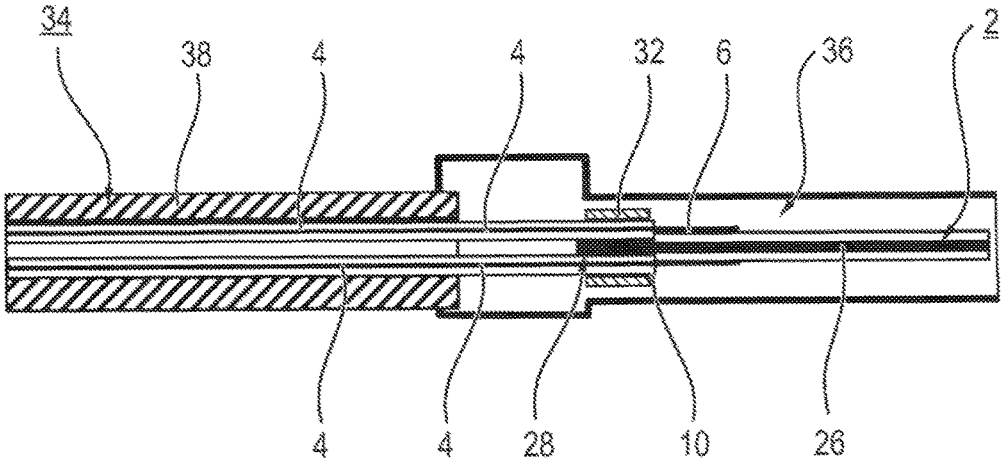
FIG. 3 is a simplified sectional view through a data cable with a connector connected thereto.

The contact connection described here between pairs of insulated wires 4 and a board 2 is used in particular in the case of high-speed data cables in which a connector 36 is connected to a corresponding data cable 34 (see FIG. 3). The connectors 36 are in particular small form pluggable connectors which are known under the abbreviated terms SFP connectors, SFP+ connectors, QSFP connectors or else CXP connectors. A connector 36 of this type is illustrated in greatly simplified form in FIG. 3. Such a connector 36 accommodates the board 2 in its interior. The data cable 34 contains a cable sheath 38 and preferably a plurality of the pairs of insulated wires 4 illustrated in FIG. 4. In the case of a QSFP connector, use is made, for example, of a data cable 34 having a total of eight pairs of insulated wires 4. In the connector 36, all of the pairs of insulated wires 4 of the data cable 34 are connected to the board 2. In this case, in each case both a contacting of the pair shielding 10 with the ground plane 26 and an electrical connection of each individual data conductor 6 to the corresponding connection pads 24 take place.

Such pre-manufactured cables with connected connectors 36 are used, for example, as "patch cables" in computer networks. The connectors 36 are introduced into connector sockets in order to form the data connection. The data connection takes place automatically here. The front-side connection pads 24 (see FIG. 2) are automatically contacted here by the corresponding contact element of the contact socket. The board 2 is therefore configured overall in the manner of a plug-in board.

The following is a summary list of reference numerals and the corresponding structure used in the above description of the invention:

2 Board
4 Pair of insulated wires
6 Data conductor
8 Insulation
10 Pair shielding
12 Carrier
14 Ground conductor
16 Insulation plane
18 Strip conductor plane
20 Component
22 Strip conductor
24 Connection pad
26 Ground plane
28 Ground contact zone
30 Metal layer
32 Clamping element
33 Sealing compound
34 Data cable
36 Connector
38 Cable sheath

The invention claimed is:

1. A cable connector, comprising:

a common clamping element;

at least one shielded data line having a shielding;

a multi-layered board having a strip conductor plane and a ground plane being different from said strip conductor plane, said ground plane projecting in a manner of a tongue in a direction of said the at least one shielded data line with a ground contact zone, and said shielded data line resting with said shielding on said ground contact zone and in contact with said ground contact zone, said shielding of said shielded data line being pressed against said ground contact zone by means of said common clamping element; and said at least one shielded data line having a pair of insulated wires surrounded by said shielding being a pair shielding and said at least one shielded data line is one of a plurality of shielded data lines disposed next to one another, said common clamping element configured as a strip and in a manner of an arc and stretches over said plurality of shielded data lines and has opposite end regions that are bent downward to said ground plane and with which said common clamping element is fastened to said ground plane.

2. The cable connector according to claim 1, wherein a ground wire is omitted in said shielded data line.

3. The cable connector according to claim 1, wherein said ground contact zone is a metal layer extending continuously over at least a large part of a width of said multi-layered board.

4. The cable connector according to claim 1, wherein said common clamping element, as seen in a longitudinal direction of said shielded data line, does not project over said shielding.

5. The cable connector according to claim 1, wherein said common clamping element is conductive and additionally serves for contacting said shielding.

6. The cable connector according to claim 1, wherein said common clamping element is of a wavy or crenellated configuration, as viewed in cross section, and therefore an individual guide for-a wire of said pair of insulated wires is formed by a respective indentation.

7. The cable connector according to claim 1, wherein said shielding contains a multi-layered film with a metal layer and with an insulation layer.

8. The cable connector according to claim 7, wherein said insulation layer is removed in said region of said ground contact zone.

9. The cable connector according to claim 1, wherein said ground plane constitutes a central plane of said multi-layered board, and said ground contact zone having said shielding of each of said shielded data lines connected thereto is formed in each case on opposite sides.

10. The cable connector according to claim 1, wherein said ground plane contains a carrier with a ground conductor fitted thereon, said ground conductor is a metallization layer.

11. The cable connector according to claim 1, further comprising a sealing compound, said ground contact zone together with said shielding, which is in contact with said ground contact zone, is enclosed by said sealing compound.

12. The cable connector according to claim 11, wherein said sealing compound is applied only in a region of said ground contact zone.

13. The cable connector according to claim 1, further comprising a data cable; and wherein said plurality of shielded data lines are combined in said data cable which is connected to said multi-layered board.

14. The cable connector according to claim 1, wherein said additional metal layer is made of gold.

15. The cable connector according to claim 11, wherein:

said shielded data line has a data conductor; and said sealing compound is applied only in a region of said ground contact zone and, also to a conductor contact region in which said data conductor of said shielded data line is in contact with said multi-layered board.

* * * * *